US010900324B2

(12) United States Patent
Grieco et al.

(10) Patent No.: US 10,900,324 B2
(45) Date of Patent: Jan. 26, 2021

(54) SLIDING SLEEVE HAVING A FLOW INHIBITOR FOR WELL EQUALIZATION

(71) Applicant: Halliburton Energy Services, Inc., Houston, TX (US)

(72) Inventors: Joseph Steven Grieco, McKinney, TX (US); Kevin Robin Passmore, McKinney, TX (US); Adam Evan Beck, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/743,426

(22) PCT Filed: Dec. 30, 2016

(86) PCT No.: PCT/US2016/069445
§ 371 (c)(1),
(2) Date: Jan. 10, 2018

(87) PCT Pub. No.: WO2018/125198
PCT Pub. Date: Jul. 5, 2018

(65) Prior Publication Data

US 2019/0309601 A1 Oct. 10, 2019

(51) Int. Cl.

| | |
|---|---|
| ***E21B 34/12*** | (2006.01) |
| ***E21B 34/14*** | (2006.01) |
| ***E21B 21/08*** | (2006.01) |
| ***E21B 34/00*** | (2006.01) |
| ***E21B 43/267*** | (2006.01) |
| ***E21B 43/14*** | (2006.01) |
| ***E21B 34/06*** | (2006.01) |
| ***E21B 43/12*** | (2006.01) |

(52) U.S. Cl.
CPC ..... *E21B 34/12* (2013.01); *E21B 21/08* (2013.01); *E21B 34/00* (2013.01); *E21B 34/06* (2013.01); *E21B 43/12* (2013.01); *E21B 43/14* (2013.01); *E21B 43/267* (2013.01); *E21B 2200/06* (2020.05)

(58) Field of Classification Search
CPC .... E21B 34/14; E21B 2034/007; E21B 34/12; E21B 34/142
See application file for complete search history.

(56) References Cited

U.S. PATENT DOCUMENTS 5,957,207 A * 9/1999 Schnatzmeyer ..... E21B 34/06 166/332.1
5,957,208 A * 9/1999 Schnatzmeyer ..... E21B 34/06 166/373
6,763,892 B2 * 7/2004 Kaszuba ..... E21B 34/101 166/332.1
2003/0056951 A1 3/2003 Kaszuba
(Continued)

*Primary Examiner* — Catherine Loikith
(74) *Attorney, Agent, or Firm* — Scott Richardson; Parker Justiss, P.C.

(57) ABSTRACT

A sliding sleeve apparatus that has a flow inhibitor that slows the fluid flow between the interior passageway of the sliding sleeve and the well annulus to allow pressure equalization between the interior passageway of the sliding sleeve and the well annulus to occur prior to placing the sliding sleeve in a fully open position. The inhibited or restricted fluid flow reduces wear on the seals and other components of the sliding sleeve, which extends the operative life of the tool.

22 Claims, 10 Drawing Sheets

(56) References Cited

U.S. PATENT DOCUMENTS

| | | | | |
|---|---|---|---|---|
| 2007/0051510 | A1 | 3/2007 | Veneruso et al. | |
| 2009/0277650 | A1 | 11/2009 | Casciaro et al. | |
| 2014/0090851 | A1 | 4/2014 | Tips et al. | |
| 2016/0168946 | A1 | 6/2016 | Haake et al. | |
| 2016/0201431 | A1* | 7/2016 | Castillo | E21B 34/14 166/373 |

* cited by examiner

SLIDING SLEEVE HAVING A FLOW INHIBITOR FOR WELL EQUALIZATION

CROSS-REFERENCE TO RELATED APPLICATION

This application is the National Stage of, and therefore claims the benefit of, International Application No. PCT/US2016/069445 filed on Dec. 30, 2016, entitled "SLIDING SLEEVE HAVING A FLOW INHIBITOR FOR WELL EQUALIZATION". The above application is commonly assigned with this National Stage application and is incorporated herein by reference in its entirety.

BACKGROUND

Sliding sleeve valves for use in oil and gas valves are well known. Sliding sleeve valves can be used to control fluid flow between a tubing string and the surrounding annulus during circulation or production. Sliding sleeve valves typically contain an inner sleeve having a port that can be selectively shifted to either permit or block fluid flow through ports in the valve body. Seals are provided between the inside wall of the valve body and the sliding sleeve to prevent fluid bypass whenever the valve is closed. Sliding sleeve valves are available in configurations that either shift down to open and up to close, or up to open and down to close. The valves are ordinarily shifted using a shifting tool that is part of a wireline-deployed tool string.

There are two main categories of sliding sleeves: open/close and choking. Open/close sleeves are shifted between a full open position and a closed position. They are used to shut off flow from a zone for economic reasons or to shut off a zone that is depleting or producing too much water. In multi-zone wells, they are used to regulate which zones to produce from and which ones to shut off. Mechanically actuated sleeves are simple and inexpensive but require actuation by a "lock," which must be run in the well on wireline or coiled tubing. Hydraulically actuated sleeves are more complicated but can be actuated from a small pump at surface. King sleeves can be used to regulate the pressure between two or more zones. They are also used to regulate the flow of fluid into a well during proppant fracturing or hydraulic fracturing operations. Choking sleeves are all hydraulically actuated and have a much more complex design than open/close sleeves.

During operation, a separation tool is pinned in the open position when run by slickline. This provides a flow path through the center of the tool while it is being set in the sliding sleeve. The separation tool adapts to most manufacturers' locks to match the nipple profile in the sliding sleeve. The lock and separation tool assembly are installed with the appropriate running tool and prong. When production is desired from an upper zone while blanking off the lower zone, a sliding sleeve with a nipple profile above and a polished sub below is installed in the tubing string opposite the upper zone. Packers are used to isolate the zones and once set.

DETAILED DESCRIPTION

Figure 1:
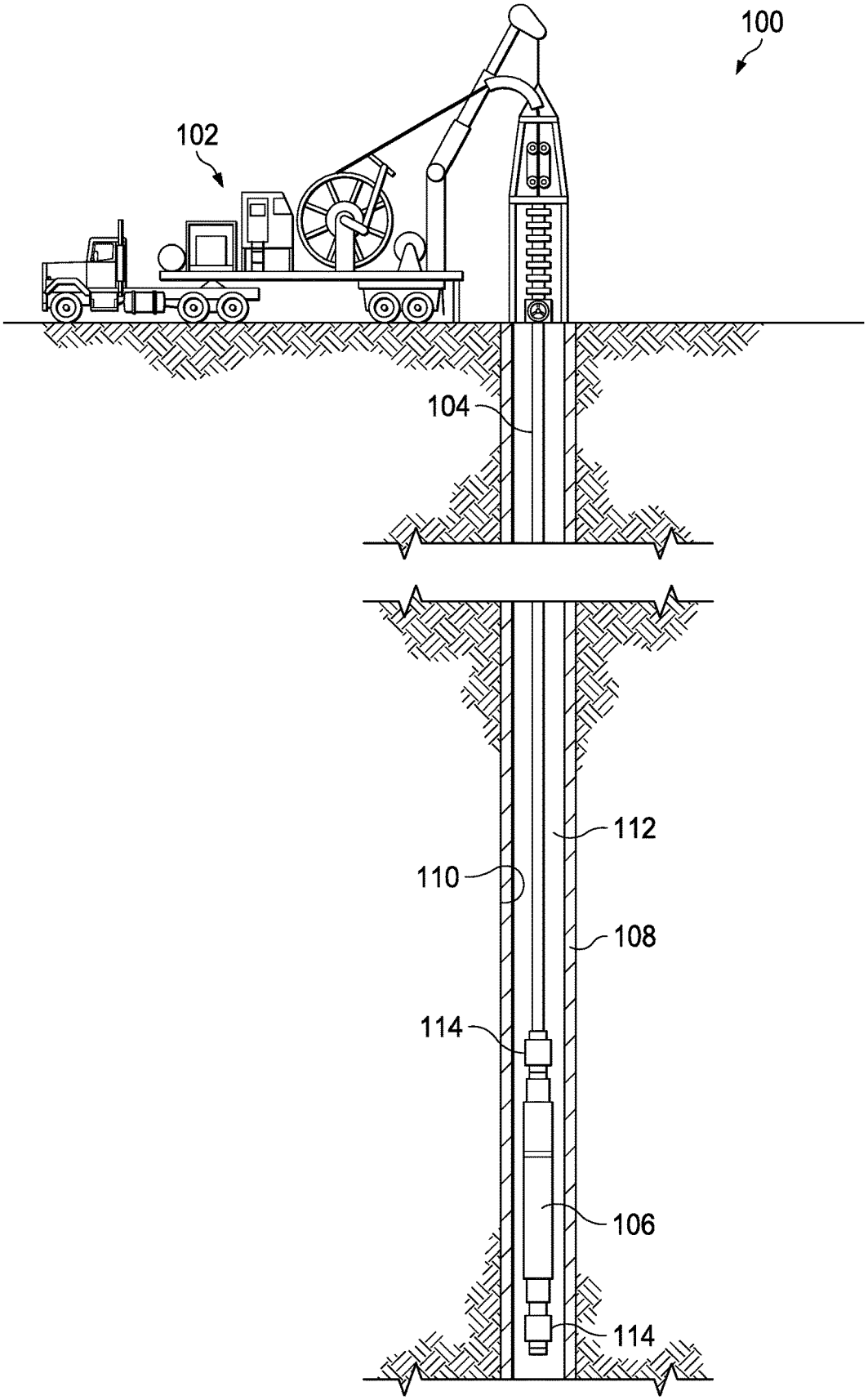
FIG. 1 illustrates a well environment in which the various embodiments of this disclosure might be used.

This disclosure, in its various embodiments, provides a sliding sleeve apparatus that has a flow inhibitor that slows the fluid flow between the interior passageway of the sliding sleeve and the well annulus to allow pressure equalization between the interior passageway of the sliding sleeve and the well annulus to occur prior to placing the sliding sleeve in a fully open position. The inhibited or restricted fluid flow reduces wear on the seals and other components of the sliding sleeve, which extends the operative life of the tool.

In the drawings and descriptions that follow, like parts are typically marked throughout the specification and drawings with the same reference numerals, respectively. The drawn figures are not necessarily to scale. Certain features of this disclosure may be shown exaggerated in scale or in somewhat schematic form and some details of conventional elements may not be shown in the interest of clarity and conciseness. Specific embodiments are described in detail and are shown in the drawings; with the understanding that they serve as examples and that, they do not limit the disclosure to only the illustrated embodiments. Moreover, it is fully recognized that the different teachings of the embodiments discussed, below, may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements but include indirect connection or interaction between the elements described, as well. As used herein and in the claims, the phrases, "operatively connected" or "configured" mean that the recited elements are connected either directly or indirectly in a manner that allows the stated function to be accomplished. These terms also include the requisite physical structure(s) that is/are necessary to accomplish the stated function. Also, the phrases "fluidly communicate," "fluid communication," or "fluidly connected," and grammatical variations thereof, mean that the recited component(s) or structure(s) is/are capable of allowing a flow of fluid between the referenced components, that is, from one component to another. However, the phrases do not require an actual flow of fluid between or through the components, but just that they are capable of providing a fluid flow between components.

In the following discussion and in the claims, the terms "including" and "comprising" are used in an open-ended fashion, and thus should be interpreted to mean "including, but not limited to." Unless otherwise specified, any use of any form of the terms "connect," "engage," "couple," "attach," or any other term describing an interaction between elements is not meant to limit the interaction to direct interaction between the elements but include indirect interaction between the elements described, as well. References to up or down are made for purposes of general special location relative to the recited components, with "up," "upper," or "uphole," meaning toward the surface of the wellbore and with "down," "lower," "downward," "downhole," or "downstream" meaning toward the terminal end of the well, as the tool would be positioned within the wellbore, regardless of the wellbore's orientation. These terms or phrases do not require that the tool be positioned in a wellbore when determining the meaning of the claims, unless specifically stated otherwise. Further, any references to "first," "second," etc. do not specify a preferred order of method or importance, unless otherwise specifically stated, but such terms are intended to distinguish one element from another. For example, a first element could be termed a second element, and, similarly, a second element could be termed a first element, without departing from the scope of example embodiments. Moreover, a first element and second element may be implemented by a single element able to provide the necessary functionality of separate first and second elements.

The various characteristics mentioned above, as well as other features and characteristics described in more detail below, will be readily apparent to those skilled in the art with the aid of this disclosure upon reading the following detailed description of the embodiments, and by referring to the accompanying drawings.

FIG. 1 generally illustrates a system 100 used to conduct the well operations as described herein. In one embodiment, the system 100 comprises a conventional workover rig or truck 102 that supplies a coiled tubing, slickline/wireline, or workover string 104 to which a sliding sleeve apparatus 106, embodiments of which are described herein, is attached. The system 100 may also include a computer, including the associated hardware and software, for controlling and monitoring the operations of the sliding sleeve apparatus 106 during the operations, as previously described. The operator may use a conventional monitoring system to determine when the sliding sleeve apparatus 106 has reached the appropriate depth in the casing 108 of the wellbore 110, which forms a well annulus 112. When the appropriate profile depth is reached, the appropriate packer or packers 114 are set. In certain embodiments, the sliding sleeve apparatus 106 may include a conventional shifting profile formed in its interior side wall that is designed to cooperate with a conventional shifting tool that can be used to shift the sliding sleeve apparatus 106 to an open position to produce a fluid flow between the well annulus 112 and the inner tube of the sliding sleeve 106.

Thus, the present disclosure presents embodiments of a sliding sleeve apparatus 106 and system 100 that provides reduce wear on the seals and other components of the sliding sleeve 106. The wellbore 110 may be, for example, an oil and gas well, or other production well that produces fluids.

Figure 2A:
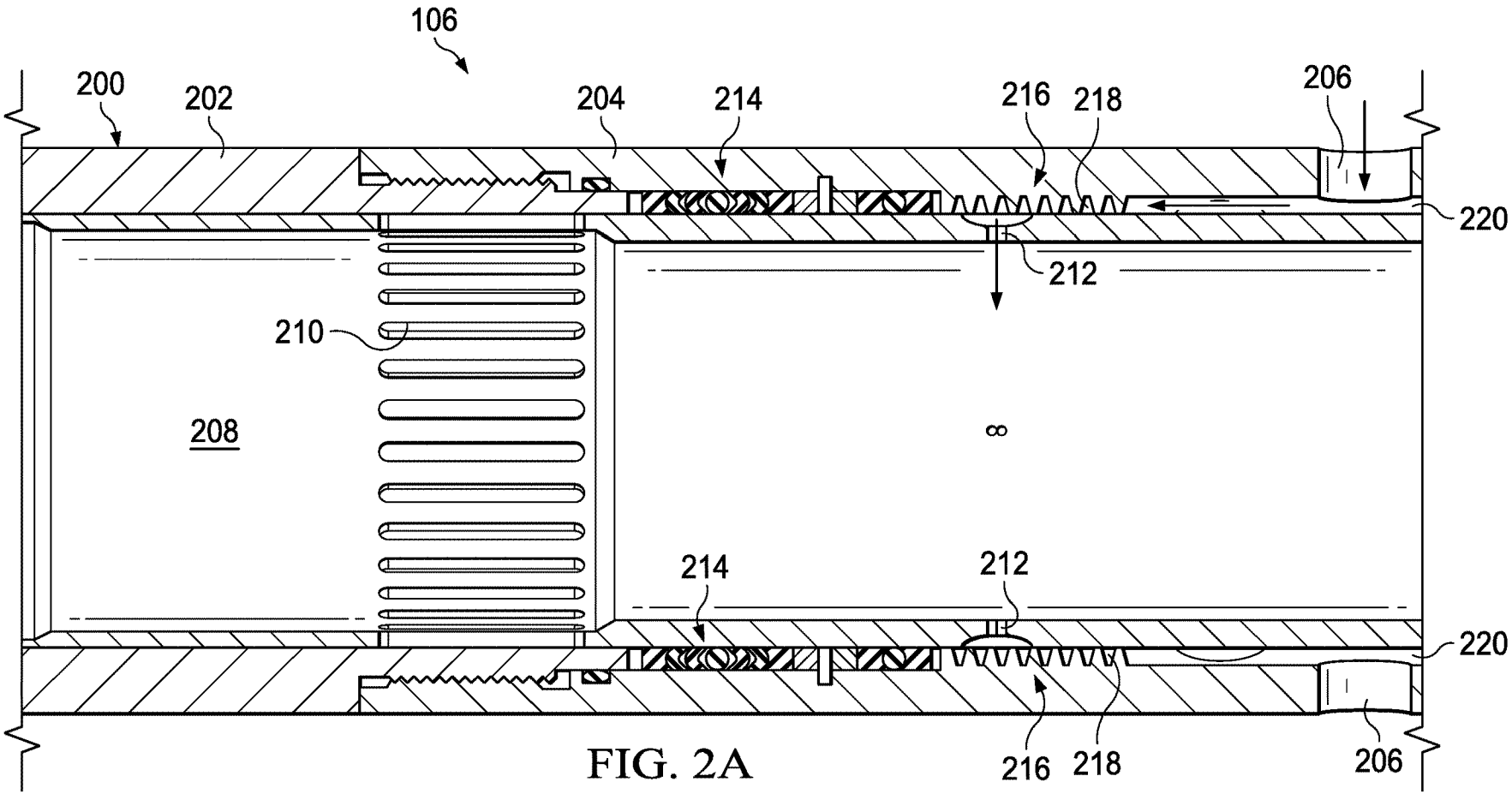
FIG. 2A illustrates a partial sectional positional view of one embodiment of a flow inhibitor as implemented in a sliding sleeve apparatus.

FIG. 2A illustrates a partial sectional view of an embodiment of the sliding sleeve apparatus 106. This embodiment comprises an outer mandrel 200. As used herein and in the claims, it should be understood, that unless otherwise specified, that the tern "mandrel" is a hollow tubular member. The outer mandrel 200 may be comprised of a number of conventional tubular components that are coupled together. For example, in the illustrated embodiment, the outer mandrel 200 comprises a first section 202, such as a sleeve retainer section, that is coupled to a second section 204, such as a center nipple section, that has fluid ports 206 located therein. The outer mandrel 200 also includes a conventional mechanism (not shown) for opening and closing the sliding sleeve. For example, the mechanism may include conventional hydraulic cylinders, or, as mentioned above, it may include a shifting profile that is designed to cooperate with a known shifting tool to open and close the sliding sleeve apparatus 106. However, other known mechanical mechanisms that are activated by lifting or turning the sliding sleeve apparatus 106 within the wellbore can also be used.

The sliding sleeve apparatus 106 further comprises a sliding sleeve 208 that is slidably located within the outer mandrel 200. The sliding sleeve 208 includes flow slots 210 located in the sliding sleeve 208 and about its perimeter. In one embodiment, the sliding sleeve 208 further includes equalization fluid ports 212 that are located about the outer perimeter of the sliding sleeve 208 and that allow for a flow of fluid therethrough.

A seal stack 214, which may be of conventional design and materials, is captured between shoulders of the first and second sections 202, 204 and is located between the outer mandrel 200 and the sliding sleeve 208. The seal stack 214 is present to provide a seal relative to the exterior of the sliding sleeve 208, which passes across the seal stack 214 during opening and closing of the fluid ports 206. Over time, the seal stack 214 represents an area of possible loss of sealing integrity. During the movement of the sliding sleeve 208 to an open position, the seal stack 214 is exposed to a surge of fluid flow, which can cause actual cutting of the seal stack 214, as pressure is equalized before a full positive opening of the sliding sleeve apparatus 106. In some instances, this may occur during complete opening of the sliding sleeve 208. In any event, any time the seal stack 214 is exposed to flow surging, it can become susceptible to damage, and as a result can leak.

To lessen the flow stress on the seal stack 214, the sliding sleeve apparatus 106 further includes a flow inhibitor 216 located below the seal stack 214 and between the outer mandrel 200 and the sliding sleeve 208. The flow inhibitor 216 is a component that is configured to inhibit a flow of fluid between the flow ports 206 and the sliding sleeve 208. In one embodiment, the flow inhibitor 216 may be a labyrinth-type flow inhibitor having a labyrinth geometry. In such embodiments, the flow inhibitor 216 is in a fixed position and in fluid communication with the flow ports 206. In other embodiments, the flow inhibitor 216 is movable, and in such embodiments, the flow inhibitor 216 is movable such that it can be placed in fluid communication with the fluid ports 206, and is initially located between the seal stack 214 fluid ports 206 when the sliding sleeve apparatus 106 is in a closed position.

The flow inhibitor 216 restricts or inhibits the flow of fluid as the sliding sleeve 208 is shifted to an open position by reducing the fluid flowrate and the pressure. In one embodiment, which is shown in FIGS. 2A-2D, the flow inhibitor 216 includes a plurality of stationary interconnected fluid channels 218 that extend around an outer perimeter of the sliding sleeve 208 and a primary fluid channel 220 that extends from the fluid ports 206 to the plurality of interconnected fluid channels 218. In this embodiment, the channels of the flow inhibitor 216 may be formed in an interior wall of the second section 204. However, in other embodiments, it may be a wholly separate component. The fluid inhibitor 216 may be comprised of metal, thermoplastics, elastomers, or a combination of these materials.

Figure 2B:
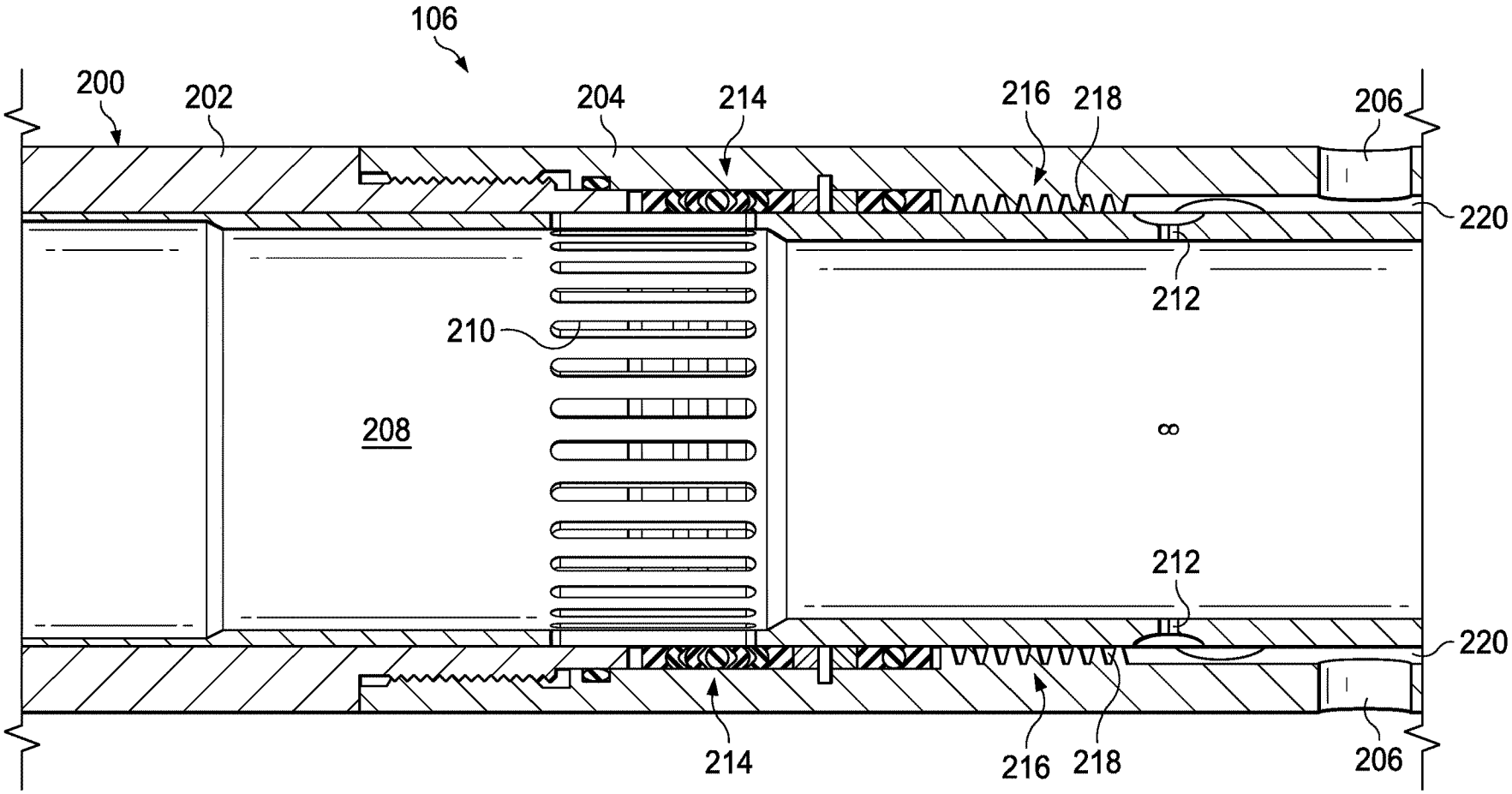
FIG. 2B illustrates a partial sectional view of an embodiment of a sliding sleeve shown in an equalizing position.

In those embodiments that include the equalization ports 212, the equalization ports 212 first pass under the flow inhibitor 216 and allows fluid communication (noted by arrows) from the annulus to the inner diameter of the sliding sleeve 208 by way of the flow inhibitor 216 and the equalization ports 212, as seen in FIG. 2A. The tortious flow path through the flow inhibitor 216, before entering the equalization ports 212, slows the fluid flow rate from the well annulus to the inner annulus of the sliding sleeve 208. The reduction in fluid flow and rate of pressure increase reduces damage to the seal stack 214 that would otherwise occur by uninhibited fluid from flowing around the seal stack 214. At this point of operation, the flow slots 210 are not able to fluidly communicate with the well annulus due to them being under the seal stack 214, as seen in FIG. 2B.

Figure 2C:
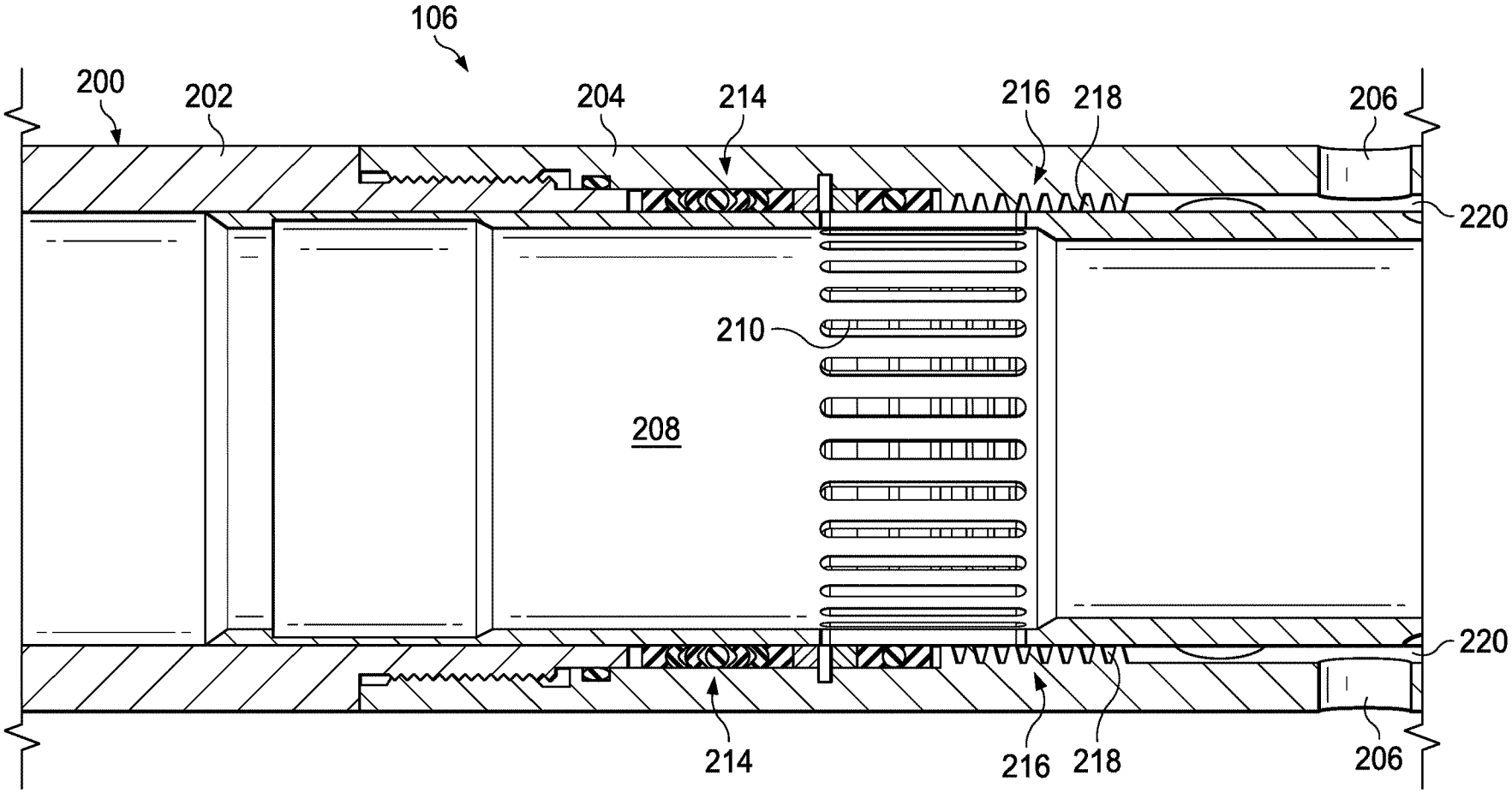
FIG. 2C illustrates a partial sectional view of an embodiment of a sliding sleeve shown with flow slots in fluid communication with the flow inhibitor.

Once the pressure differential has fully equalized by way of the equalization ports 212, the sliding sleeve 208 is shifted further downhole such that the flow slots 210 are in fluid communication with the flow inhibitor 216, as shown in FIG. 2C. Pressure sensors associated with the sliding sleeve apparatus 106 transmit the pressure signals to a controller located at the surface of the wellbore. In the event the pressure differential is unable to equalize fully before shifting the sliding sleeve 208 to an open position, or the equalization ports 212 are not present, the flow inhibitor 216 operates in the same manner for the flow slots 210 as with the equalization ports 212. Fluid flow and the rate of pressure increase is decreased due to the flow inhibitor's 216 geometry, which helps protect the seal stack 214 from damage that can occur by high flow rates and high pressure.

Figure 2D:
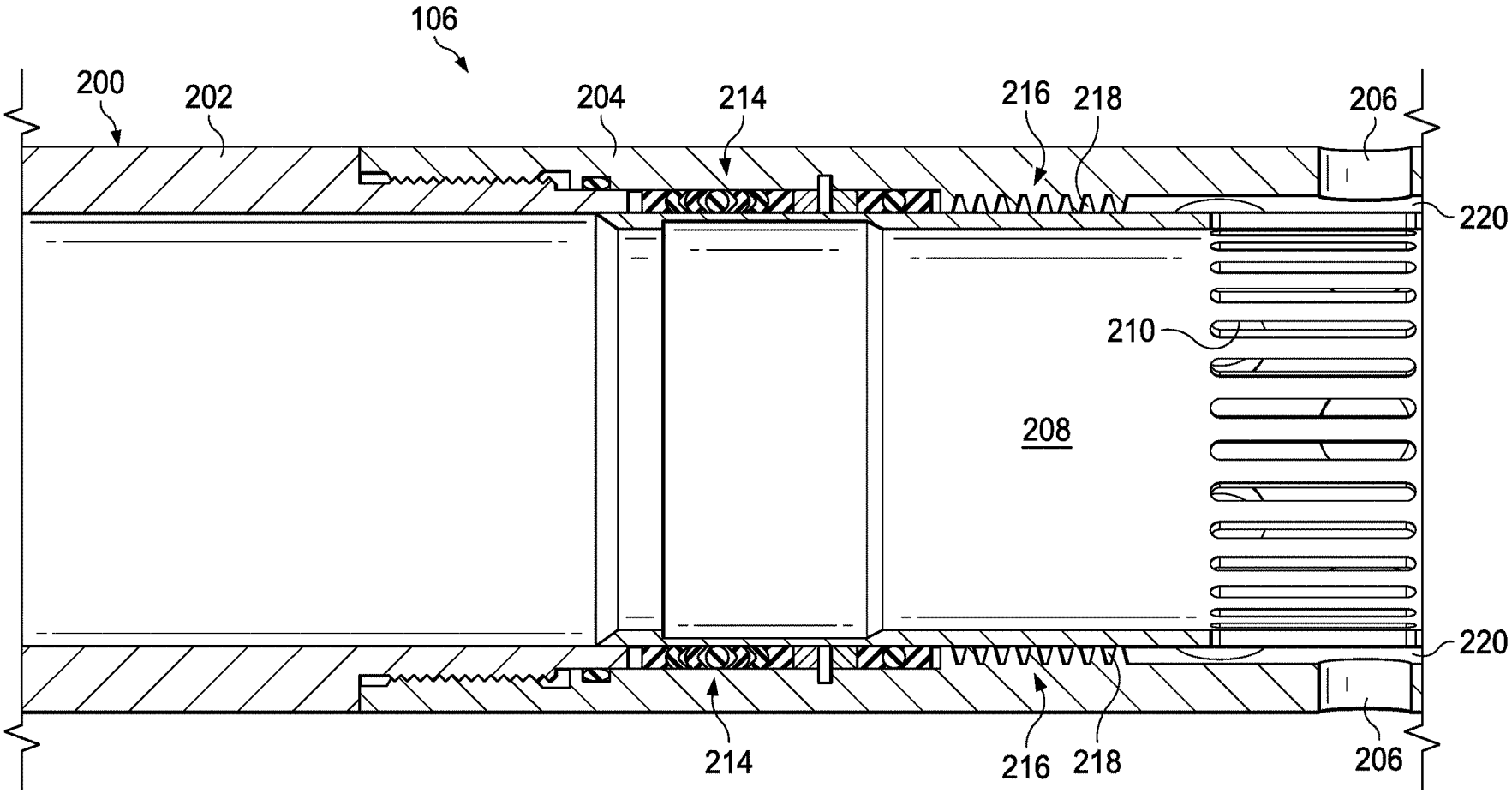
FIG. 2D illustrates a partial sectional view of an embodiment of a sliding sleeve shown with the flow slots aligned with the flow ports in an open position.

FIG. 2D illustrates the sliding sleeve apparatus 106 in a fully open position. At this point, the fluid flow ports 210 have been shifted past the flow inhibitor 216 and are aligned with the fluid ports 206, which allow the fluid to flow freely between the well annulus and the interior of the sliding sleeve.

Figure 3:
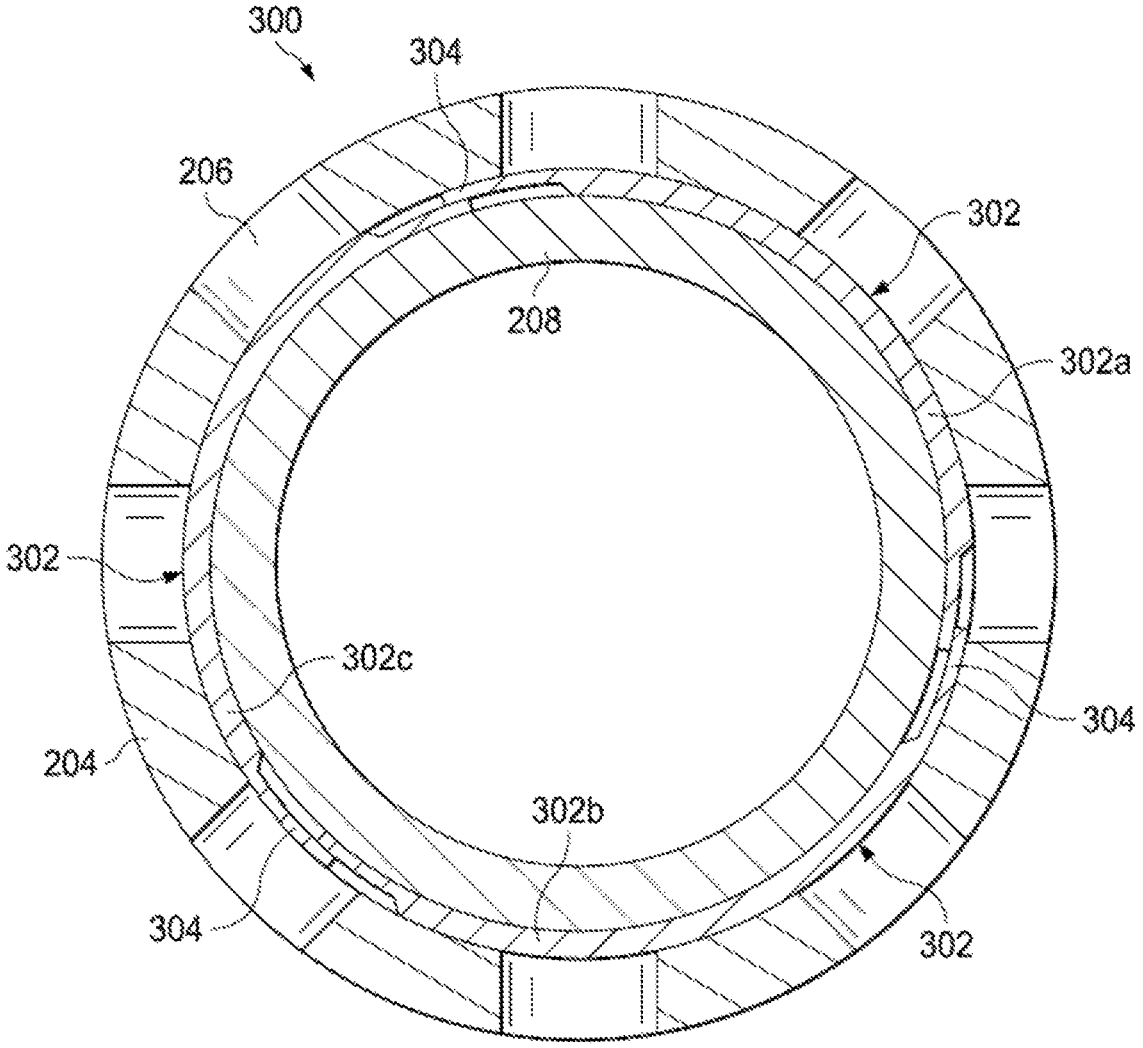
FIG. 3 illustrates a sectional view of another embodiment of a flow inhibitor that can be implemented in a sliding sleeve.

FIG. 3 illustrates another embodiment of a flow inhibitor 300, which in one embodiment may be similar in certain respects to the flow inhibitor 216 used in the sliding sleeve apparatus 106 illustrated in FIGS. 2A-2D. In one embodiment, the flow inhibitor 300 includes one or more curved plates 302 that have a radius of curvature that extend(s) around an outer perimeter of the sliding sleeve 208 and is slidable with respect to the second section 204 of the outer mandrel 200. As mentioned above, the curved plate(s) 302 may be comprised of metal, thermoplastics, elastomers, or a combination of these materials. The curved plate(s) 302 is/are contained under the flow ports 206 and rest on the outer diameter of the sliding sleeve 208. The curved plate(s) 302 is/are designed so there is little flow area around the curve plate(s) 302, when the sliding sleeve 208 is opened. It should also be noted that the number of curved plate(s) 302 can vary, depending on the material and design restrictions.

In one embodiment, the flow inhibitor 300 comprises a plurality of the curved plates 302 that have overlapping ends 304 that form a fluid path. As explained below, the curved plate(s) is/are slidable to place the fluid path in fluid communication with the fluid ports 206. In one aspect of this embodiment, the curved plates 302 comprise first, second, and third curved plates 302*a*, 302*b*, and 302*c*, wherein an end of the first plate 302*a* overlaps ends of the second and third plates 302*b*, 302*c*, and another end of the second plate 302*b* overlaps another end of the third plate 302*b* to form fluid paths therethrough. At least one of the fluid paths is in fluid communication with one of the fluid ports 206, as generally shown, when the sliding sleeve apparatus 106 is in a closed position. The overlapping ends of the curved plates 302*a*-302*c* form restricted flow path channels that form a tortuous fluid path that reduces the flowrate and pressure as the flow slots of the sliding sleeve 208 are moved into fluid communication with the fluid ports 206. In those embodiments where the flow inhibitor 300 consists of a single curved plate, the plate may have a plurality of small openings formed through the plate that creates the tortuous fluid path.

Figure 4:
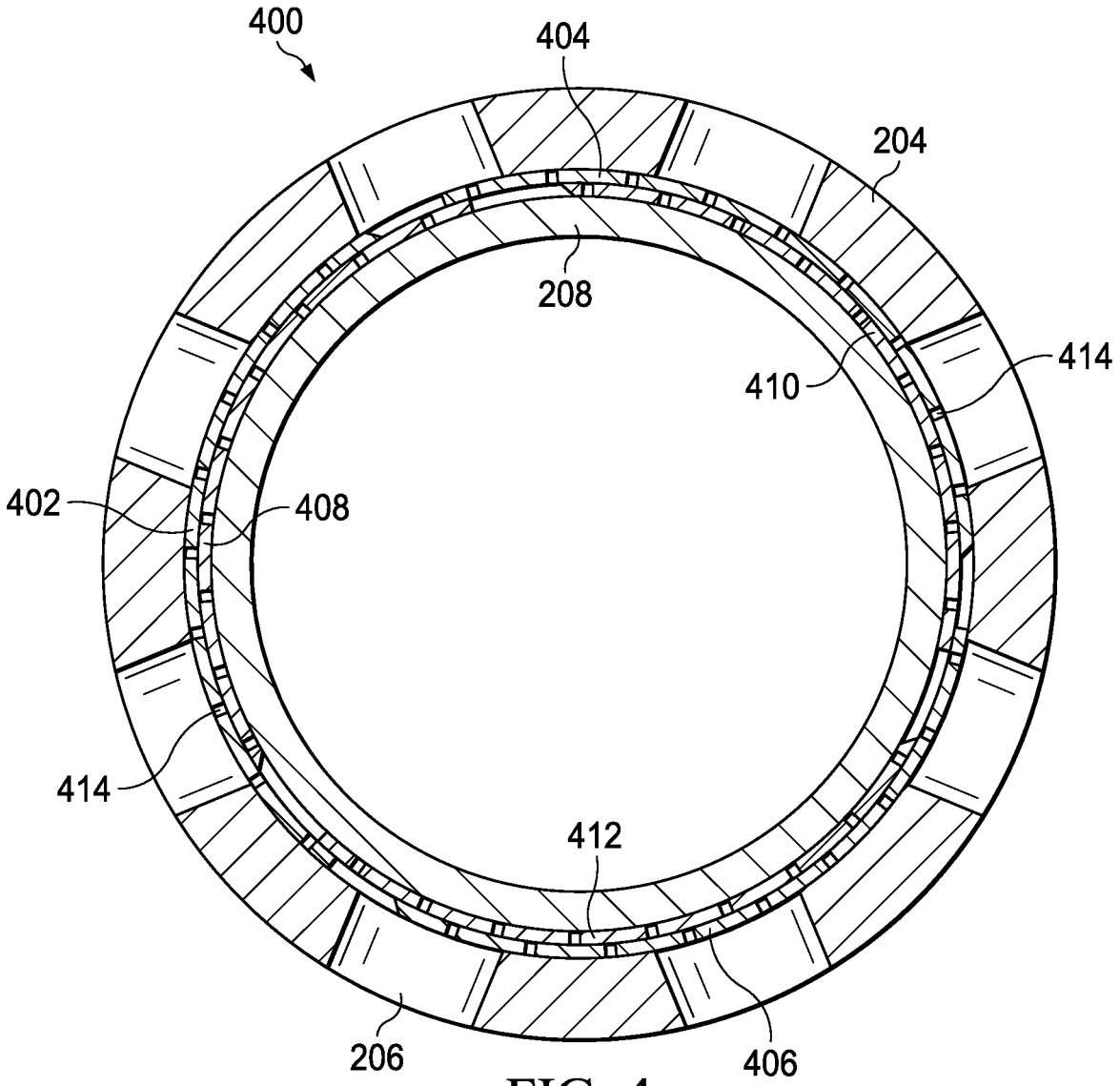
FIG. 4 illustrates a sectional view of another embodiment of a flow inhibitor that can be implemented in a sliding sleeve.

FIG. 4 illustrates another embodiment of the flow inhibitor 400, which in one embodiment may be similar in certain respects to the flow inhibitor 216 used in the sliding sleeve apparatus 106 illustrated in FIGS. 2A-2D. In this embodiment, the flow inhibitor 300 comprises a plurality of concentric overlapping curved plates 402-412. As with the previous embodiment of FIG. 3, the tortuous fluid path is created by the overlapping curved plates 402-412. In one embodiment, the curved plates 402-412 may include micron sized (e.g., 0.01 microns) openings 414, (only two of which are designated for clarity) therethrough that add an additional dimension to the tortuous fluid path of the flow inhibitor 300.

Figure 5A:
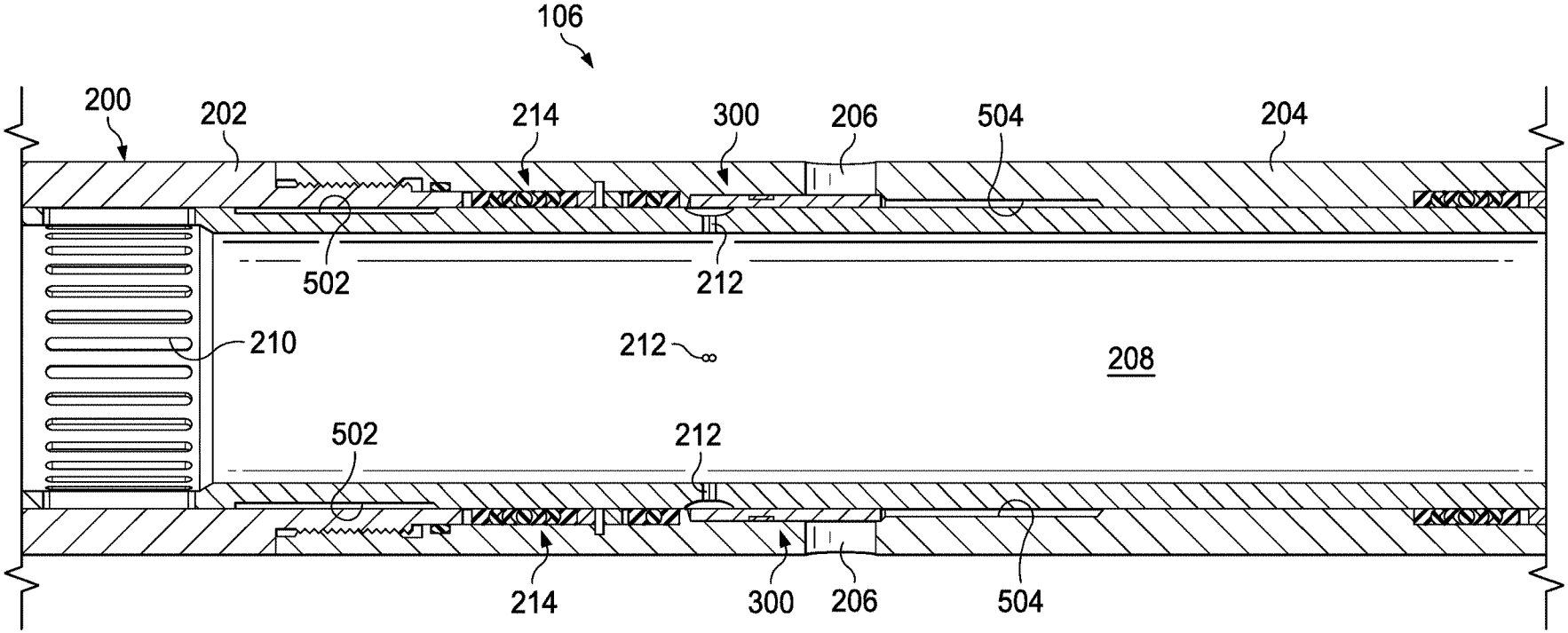
FIG. 5A illustrates a partial sectional view of an embodiment of a sliding sleeve shown in an equalizing position.

FIG. 5A illustrates the sliding sleeve apparatus 106 in which the embodiments of the flow inhibitor 300 may be implemented. It should be noted that similar elements, as discussed regarding previous embodiments, are designated by the same reference numbers. In this embodiment, the sliding sleeve 208 further comprises a flow inhibitor profile 502 formed in an outer perimeter thereof that is configured to receive the embodiments of the flow inhibitor 300 therein. This embodiment may further include a flow inhibitor profile 504 formed in the inner wall of the second section 204, which cooperates with the flow inhibitor profile 502 to shift the flow inhibitor 300 into the flow inhibitor profile 502.

FIG. 5A illustrates the sliding sleeved apparatus 106 in a closed position. The sliding sleeve 208 is shifted to an equalizing position, as shown. The flow inhibitor 300 is positioned on the downhole side of the seal stack 214. In this position, the equalization port 212 is in fluid communication with the flow ports 206, and thus, the well annulus, which is not shown in this view. The flow inhibitor 300 is positioned between the seal stack 214 and the flow ports 206. The flow inhibitor 300 allows fluid to flow, in a restricted manner from the well annulus through the flow ports 206 and flow inhibitor 212 and into the interior of the sliding sleeve 208. The fluid flow rate between the annulus and the sliding sleeve 208 is slowed by the curved plate(s) reducing the flow area through the sliding sleeve apparatus 106. In this position, the flow slots 210 are not able to fluidly communicate with the annulus due to remaining on the other side of the seal stack 214. As with previous embodiments, the tortious flow path through the flow inhibitor 300, before entering the equalization ports 212, slows the fluid flow rate from the well annulus to the inner annulus of the sliding sleeve 208. This reduction in fluid flow reduces damages that may occur to the seal stack 214 that might otherwise occur by uninhibited fluid from flowing around the seal stack 214.

Figure 5B:
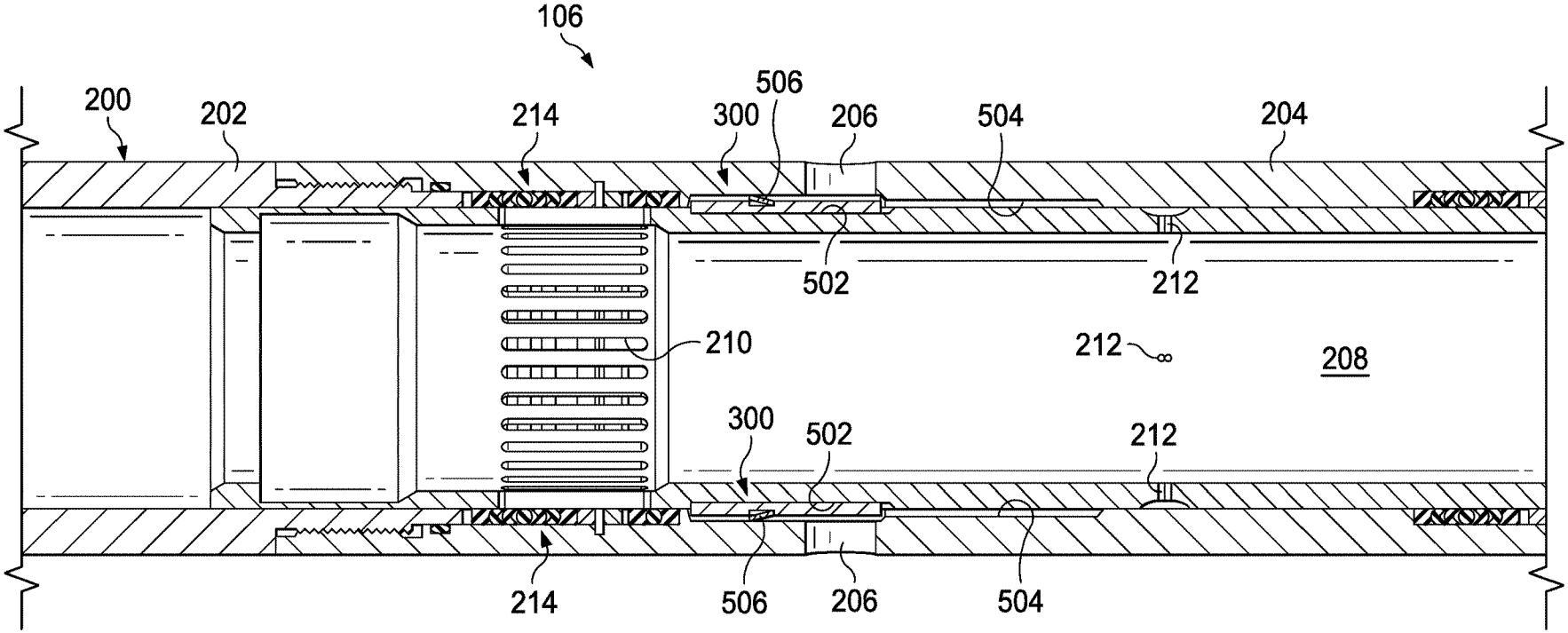
FIG. 5B illustrates a partial sectional view of an embodiment of a sliding sleeve with the flow inhibitor received within a flow inhibitor profile of the sliding sleeve.

Once the pressure differential is equalized, the sliding sleeve 208 is shifted toward an open position, as generally shown in FIG. 5B. During the shifting process, the flow inhibitor 300 retracts into the flow inhibitor profile 502, which allows the shifting of the shifting sleeve 208 to proceed. In an embodiment, the flow inhibitor 300 can be retracted by a spring 506 wrapped around the outer diameter of the sliding sleeve 208 and the flow inhibitor 300. Some embodiments of the sliding sleeve apparatus 106 can be designed so the flow slots 210 are under or on either side of the seal stack 214 before the flow inhibitor 300 is retracted, depending on the application that is required.

Figure 5C:
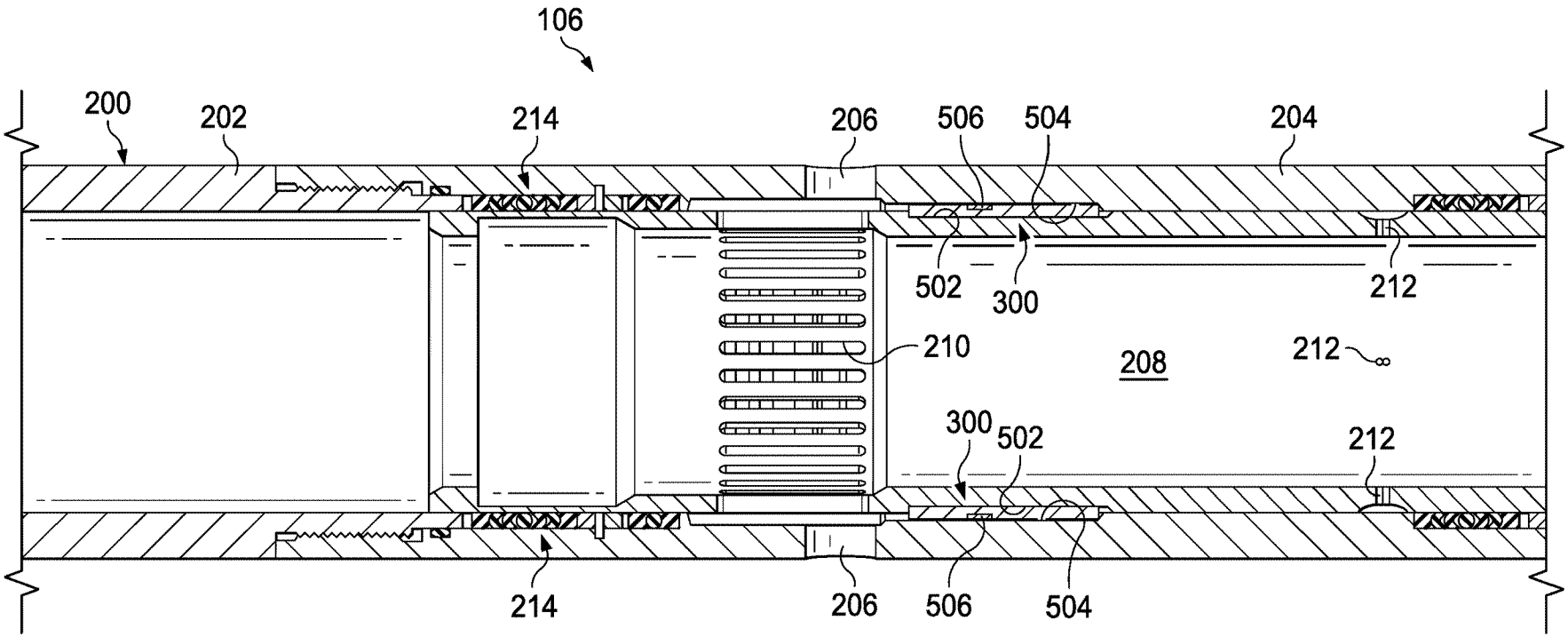
FIG. 5C illustrates a partial sectional view of an embodiment of a sliding sleeve shown with the flow slots aligned with the flow ports in an open position.

FIG. 5C illustrates the sliding sleeve 208 shifted to a fully open position, which allows full fluid communication and flow area through the flow ports 206 and between the well annulus and the interior of the sliding sleeve 208. The flow inhibitor 300 is moved out of the flow path and is received into the flow inhibitor profile 504 formed in the second section 204.

Embodiments herein comprise:

A sliding sleeve apparatus. This embodiment comprises an outer mandrel a first section coupled to a second section and having fluid ports located through the second section and about an outer perimeter thereof. A sliding sleeve is slidably located within the outer mandrel and includes flow slots located therethrough and about an outer perimeter thereof. A seal stack is captured between the first and second sections and is located between the first section and the fluid ports. A flow inhibitor is located between the second section and the sliding sleeve and below said seal stack. The flow inhibitor is configured to inhibit a flow of fluid between the fluid ports and the sliding sleeve.

Another embodiment is directed to a well servicing system. This embodiment comprises a servicing rig having tubing associated therewith that can be inserted into a wellbore. A sliding sleeve apparatus is coupled to the tubing and is configured to flow a fluid from an annulus of the wellbore into the sliding sleeve apparatus. The sliding sleeve apparatus comprised an outer mandrel having a first section coupled to a second section and having fluid ports located through the second section and about an outer perimeter thereof. A sliding sleeve is slidably located within the outer mandrel and has flow slots and equalization ports located therethrough and about an outer perimeter thereof. A seal stack is captured between the first and second sections and is located between the first section and the fluid ports. A flow inhibitor is located between the second section and the sliding sleeve and below the seal stack. The flow inhibitor is configured to inhibit a flow of fluid between the fluid ports and the equalization ports.

Another embodiment is directed to a method of flowing a fluid in a well. This embodiment comprises attaching a sliding sleeve apparatus to a service tubing and positioning the sliding sleeve apparatus into a wellbore. The sliding sleeve apparatus comprises an outer mandrel having a first section coupled to a second section and having fluid ports located through the second section and about an outer perimeter thereof. A sliding sleeve is slidably located within the outer mandrel and has equalization fluid ports and flow slots located therein. A seal stack is captured between the first and second sections and is located between said first section and said fluid ports. A flow inhibitor is located between the second section and the sliding sleeve and below the seal stack. The flow inhibitor is configured to inhibit a flow of fluid between the fluid ports and the equalization ports. The sliding sleeve apparatus is positioned in the well and equalization ports are positioned under the flow inhibitor to bring the equalization fluid ports into fluid communication with the flow inhibitor and the fluid ports. The sliding sleeve is slid within the outer mandrel to an open position to position the flow slots adjacent the fluid ports.

Each of the foregoing embodiments may comprise one or more of the following additional elements singly or in combination, and neither the example embodiments or the following listed elements limit the disclosure, but are provided as examples of the various embodiments covered by the disclosure:

Element 1: wherein the flow inhibitor includes a plurality of stationary interconnected fluid channels that extend around an outer perimeter of the sliding sleeve and a primary fluid channel that extends from the fluid ports to the plurality of fluid channels.

Element 2: wherein the conduit system further comprises an outlet conduit system coupled to respective outlet ends of each of the hydration tanks that have a portion of the plurality of fluid valves interposed the outlet conduit and operatively coupled to the controller to receive commands from the controller to empty a filled hydration tank of the hydration tanks.

Element 3: wherein the flow inhibitor includes one or more curved plates that extend around an outer perimeter of the sliding sleeve and are slidable with respect to the outer mandrel.

Element 4: wherein the curved plates comprise first, second, and third curved plates wherein an end of the first plate overlaps ends of the second and third plates and another end of the second plate overlaps another end of the third plate to form fluid paths therethrough wherein at least one of the fluid paths is in fluid communication with one of the fluid ports.

Element 5: wherein the curved plates each have a plurality of fluid openings extending therethrough.

Element 6: wherein the sliding sleeve further comprises a flow inhibitor profile formed in an outer perimeter thereof and configured to receive the flow inhibitor therein.

Element 7: wherein the sliding sleeve further includes equalization fluid ports located therethrough and about an outer perimeter thereof.

Element 8: wherein the flow inhibitor includes a plurality of interconnected fluid channels that extend around an outer perimeter of the sliding sleeve and a primary fluid channel that extends from the fluid ports to the plurality of fluid channels.

Element 9: wherein the flow inhibitor includes one or more curved plates that extend around an outer perimeter of the sliding sleeve and are slidable with respect to the outer mandrel.

Element 10: wherein the flow inhibitor comprises a plurality of the curved plates having overlapping ends that form a fluid path, the curved plates being slidable to a position to place the fluid path in fluid communication with the fluid communication port.

Element 11: wherein the curved plates each have a plurality of fluid openings extending therethrough.

Element 12: wherein the curved plates are positionable within a sliding sleeve profile of the sliding sleeve.

Element 13: wherein the flow inhibitor includes a plurality of stationary interconnected fluid channels that extend around an outer perimeter of the sliding sleeve and a primary fluid channel that extends from the fluid ports to the plurality of fluid channels.

Element 14: wherein the flow inhibitor includes a plurality of curved plates having overlapping ends that form at least one fluid path, and wherein positioning the equalization ports includes positioning the equalization ports under the at least one fluid path to bring the equalization ports into fluid communication with the at least one fluid path and the fluid ports.

Element 15: wherein the curved plates, at the point of overlap, form a plurality of fluid paths and positioning the equalization ports includes positioning the equalization ports under at least one of the plurality of fluid paths.

Element 16: wherein the curved plates each have a plurality of fluid openings extending therethrough and positioning the equalization ports includes positioning the equalization ports under the plurality of fluid openings to bring the equalization ports into fluid communication with the at least one fluid path and the fluid ports.

Element 17: wherein sliding the sliding sleeve to an open position includes positioning the curved plates within a sliding sleeve profile of the sliding sleeve.

The foregoing listed embodiments and elements do not limit the disclosure to just those listed above, and those skilled in the art to which this application relates will appreciate that other and further additions, deletions, substitutions and modifications may be made to the described embodiments.

What is claimed is:

1. A sliding sleeve apparatus, comprising:

an outer mandrel having a first section coupled to a second section and having fluid ports located through said second section and about an outer perimeter thereof;

a sliding sleeve slidably located within said outer mandrel and having flow slots located therethrough and about an outer perimeter thereof;

a seal stack captured between said first and second sections and being located between said first section and said fluid ports; and a flow inhibitor located between said second section and said sliding sleeve and below said seal stack, said flow inhibitor including a tortious fluid path configured to allow but inhibit a flow of fluid between said fluid ports and said seal stack.

2. The sliding sleeve apparatus of claim 1, wherein said flow inhibitor includes a plurality of stationary interconnected fluid channels that extend around an outer perimeter of said sliding sleeve and a primary fluid channel that extends from said fluid ports to said plurality of fluid channels.

3. The sliding sleeve apparatus of claim 1, wherein said flow inhibitor includes one or more curved plates that extend around an outer perimeter of said sliding sleeve and are slidable with respect to said outer mandrel.

4. The sliding sleeve apparatus of claim 3, wherein said flow inhibitor comprises a plurality of said curved plates having overlapping ends that form a fluid path, said curved plates being slidable to place said fluid path in fluid communication with said fluid communication port.

5. The sliding sleeve apparatus of claim 3, wherein said curved plates comprise first, second, and third curved plates wherein an end of said first plate overlaps ends of said second and third plates and another end of said second plate overlaps another end of said third plate to form fluid paths therethrough wherein at least one of said fluid paths is in fluid communication with one of said fluid ports.

6. The sliding sleeve apparatus of claim 3 wherein said curved plates each have a plurality of fluid openings extending therethrough.

7. The sliding sleeve apparatus of claim 3 wherein said sliding sleeve further comprises a flow inhibitor profile formed in an outer perimeter thereof and configured to receive said flow inhibitor therein.

8. The sliding sleeve apparatus of claim 1 wherein said sliding sleeve further includes equalization fluid ports located therethrough and about an outer perimeter thereof.

9. The sliding sleeve apparatus of claim 1, wherein said flow inhibitor is radially located between said second section and said outer perimeter of said sliding sleeve.

10. The sliding sleeve apparatus of claim 1, wherein the flow inhibitor is fixedly captured between said first and second sections to not slide with the sliding sleeve.

11. A well servicing system, comprising:

a servicing rig having a tubing associated therewith, said tubing positionable within a wellbore; and a sliding sleeve apparatus coupled to said tubing and configured to flow a fluid from an annulus of said wellbore into said sliding sleeve apparatus, comprising:

an outer mandrel having a first section coupled to a second section and having fluid ports located through said second section and about an outer perimeter thereof;

a sliding sleeve slidably located within said outer mandrel and having flow slots and equalization ports located therethrough and about an outer perimeter thereof;

a seal stack captured between said first and second sections and being located between said first section and said fluid ports; and a flow inhibitor located between said second section and said sliding sleeve and below said seal stack, said flow inhibitor including a tortious fluid path configured to allow but inhibit a flow of fluid between said fluid ports and said seal stack.

12. The well servicing system of claim 11, wherein said flow inhibitor includes a plurality of interconnected fluid channels that extend around an outer perimeter of said sliding sleeve and a primary fluid channel that extends from said fluid ports to said plurality of fluid channels.

13. The well servicing system of claim 11, wherein said flow inhibitor includes one or more curved plates that extend around an outer perimeter of said sliding sleeve and are slidable with respect to said outer mandrel.

14. The well servicing system of claim 13, wherein said flow inhibitor comprises a plurality of said curved plates having overlapping ends that form a fluid path, said curved plates being slidable to a position to place said fluid path in fluid communication with said fluid communication port.

15. The well servicing system of claim 13, wherein said curved plates each have a plurality of fluid openings extending therethrough.

16. The well servicing system of claim 13, wherein said curved plates are positionable within a sliding sleeve profile of said sliding sleeve.

17. A method of flowing a fluid in a well, comprising:

attaching a sliding sleeve apparatus to a service tubing, said sliding sleeve apparatus comprising:

an outer mandrel having a first section coupled to a second section and having fluid ports located through said second section and about an outer perimeter thereof;

a sliding sleeve slidably located within said outer mandrel and having equalization fluid ports and flow slots located therein;

a seal stack captured between said first and second sections and being located between said first section and said fluid ports; and a flow inhibitor located between said second section and said sliding sleeve and below said seal stack, said flow inhibitor including a tortious fluid path configured to allow but inhibit a flow of fluid between said fluid ports and said seal stack;

positioning said sliding sleeve apparatus in said well;

positioning the equalization fluid ports under said flow inhibitor to bring said equalization fluid ports into fluid communication with said flow inhibitor and said fluid ports; and sliding said sliding sleeve within said outer mandrel to an open position to position said flow slots adjacent said fluid ports.

18. The method of claim 17, wherein said flow inhibitor includes a plurality of stationary interconnected fluid channels that extend around an outer perimeter of said sliding sleeve and a primary fluid channel that extends from said fluid ports to said plurality of fluid channels.

19. The method of claim 17, wherein said flow inhibitor includes a plurality of curved plates having overlapping ends that form at least one fluid path, and wherein positioning said equalization ports includes positioning said equalization ports under said at least one fluid path to bring said equalization ports into fluid communication with said at least one fluid path and said fluid ports.

20. The method of claim 19 wherein said curved plates, at a point of overlap, form a plurality of fluid paths and positioning said equalization ports includes positioning said equalization ports under at least one of said plurality of fluid paths.

21. The method of claim 19, wherein said curved plates each have a plurality of fluid openings extending therethrough and positioning said equalization ports includes positioning said equalization ports under said plurality of fluid openings to bring said equalization ports into fluid communication with said at least one fluid path and said fluid ports.

22. The method of claim 19, wherein sliding said sliding sleeve to an open position includes positioning said curved plates within a sliding sleeve profile of said sliding sleeve.

* * * * *